United States Patent [19]

Lems

[11] Patent Number: 4,828,110

[45] Date of Patent: May 9, 1989

[54] UNITIZED PACKAGE

[75] Inventor: Peter Lems, Wilmette, Ill.

[73] Assignee: Illinois Tool Works Inc., Glenview, Ill.

[21] Appl. No.: 660,019

[22] Filed: Oct. 12, 1984

[51] Int. Cl.[4] ..... B65D 75/00

[52] U.S. Cl. ..... 206/427; 206/150; 206/432; 206/434

[58] Field of Search ..... 206/150, 192, 427, 430, 206/432, 434

[56] References Cited

U.S. PATENT DOCUMENTS

| | | | |
|---|---|---|---|
| 3,286,833 | 11/1966 | Chadbourne | 206/192 |
| 3,338,404 | 8/1967 | Becker et al. | 206/427 |
| 3,404,773 | 10/1968 | Kirby, Jr. | 206/432 |
| 3,930,578 | 1/1976 | Stein | 206/150 |
| 3,944,074 | 3/1976 | Riley | 206/150 |
| 4,269,314 | 5/1981 | Barrash | 206/150 |
| 4,300,681 | 11/1981 | Klygis et al. | 206/432 |
| 4,304,332 | 12/1981 | Dante | 206/427 |
| 4,385,691 | 5/1983 | Klygis | 206/150 |
| 4,416,373 | 11/1983 | de Larosiere | 206/432 |
| 4,483,430 | 11/1984 | Kobiella | 206/83.5 |
| 4,596,330 | 6/1986 | Benno | 206/427 |

*Primary Examiner*—David T. Fidei

*Attorney, Agent, or Firm*—Dressler, Goldsmith, Shore, Sutker & Milnamow, Ltd.

[57] ABSTRACT

A unitized package of a plurality of generally cylindrical containers, such as cans or bottles, is disclosed. The package is sufficiently rigid to maintain a stable configuration upon handling even when the package is constituted by a relatively large number of containers. The unitized package comprises several independent, integral container cells of equal size that are held contiguous to one another by a resilient film ribbon under tension. The resilient film ribbon is in contact with the packaged containers about the periphery of the package along a major portion of the container cylindrical body portion length dimension. A particularly well suited film ribbon material for the foregoing purposes is oriented polypropylene film about 3 to 5 mils thick.

10 Claims, 1 Drawing Sheet

FIG. 1
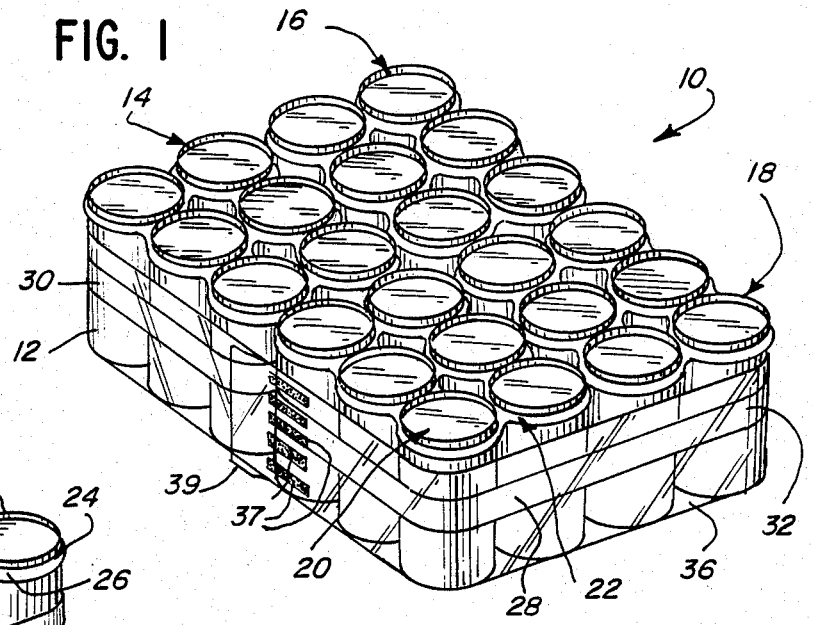
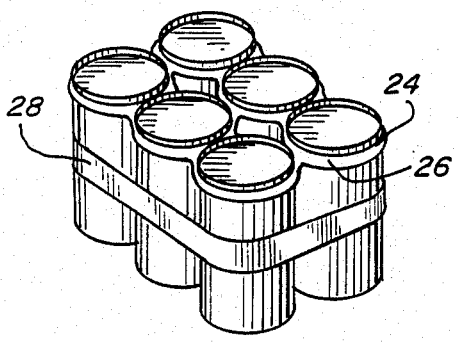
FIG. 2
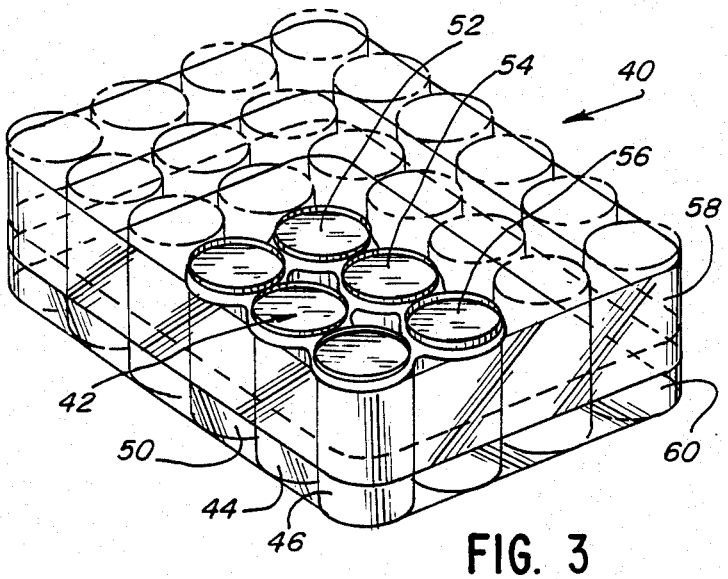
FIG. 3
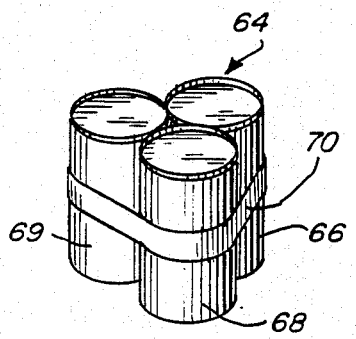
FIG. 4
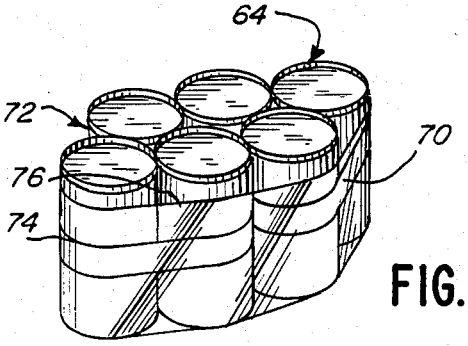
FIG. 5

UNITIZED PACKAGE

BACKGROUND OF THE INVENTION

This invention relates to a package of a plurality of generally cylindrical containers such as cans or bottles.

Typical of the heretofore known multiple container packages are those shown in U.S. Pat. Nos. 2,874,835, 3,084,792, 4,018,331 and 4,269,308. While such packages appear to be adequate for packaging relatively small groups of containers, i.e., six containers or less, for packaging larger groups of containers, i.e., twelve containers per package, such packages at best have marginal rigidity.

While U.S. Pat. Nos. 4,018,331 and 4,269,308 allege a packaging capability for twelve or more containers, the resulting packages appear to be capable of acceptable packaging of only twelve containers. Also, the packaged containers nevertheless can and do skew undesirably with respect to one another when such packages are handled.

SUMMARY OF THE INVENTION

The present invention contemplates a unitized package of a plurality of containers having a cylindrical body portion, such as cans or bottles, arranged in rows and columns. The unitized package is sufficiently rigid to maintain a stable configuration upon normal handling even when the package is constituted by a relatively large number of containers, e.g., twenty-four containers per package.

The present unitized package is made up of several independent, integral container cells of equal size that are held contiguous to one another in the package by means of a resilient film ribbon. The contiguous container cells are circumscribed by a resilient film ribbon under tension. Tension in the film ribbon is distributed substantially uniformly across the width of the film ribbon. Preferably, each unitized package is made up of four integral container cells which form four quadrants of the package.

Each container cell includes a separate container connecting means and at least two containers aligned with one another. The aligned containers are individually gripped by the connecting means so that movement of the gripped, aligned containers relative to one another is restricted. The container connecting means can be a sheet-form plastic can or bottle carrier provided with apertures that are slightly less in diameter than a portion of the individual container that can be pushed therethrough and retained in place by a bead or other peripheral seam or protuberance. Alternatively, the container connecting means can be a band circumscribing the cell containers and holding the circumscribed containers together One or both of the foregoing container connecting means can be utilized at any given time.

The resilient film ribbon is in contact with packaged containers about the periphery of the package along a major portion of the container cylindrical body portion length dimension. Additionally, the resilient film ribbon is under a tension of at least about one pound force per pound of total package weight. The film ribbon tension is not so great, however, as to impair the configurational integrity of individual containers in the package.

Particularly well suited resilient flexible film ribbon material for the present purposes is oriented polypropylene film about 3 to 5 mils thick; however, other film materials exhibiting suitable strength and stress retention properties can be used as well.

BRIEF DESCRIPTION OF THE DRAWING

In the drawing,

FIG. 1 is a perspective view of a unitized package embodying the present invention and constituted by four independent but contiguous container cells;

FIG. 2 is a perspective view of an individual cell of six containers individually secured to an apertured plastic can carrier and circumscribed by a rigidifying band;

FIG. 3 is a perspective view of a container constituting one quadrant in a unitized package, the other three quadrants of the unitized package being shown in phantom;

FIG. 4 is a perspective view of another individual cell, constituted by three containers and gripped by a band-type container connecting means; and FIG. 5 is a perspective view of a unitized package constituted by two individual cells of the type shown in FIG. 4.

DETAILED DESCRIPTION OF PREFERRED EMBODIMENTS

As used herein and in the appended claims, the term "film" designates sheetform material having a thickness of about 10 mils or less.

Referring to FIG. 1, unitized package 10 of containers, specifically cans 12, is made up of contiguous individual container cells 14, 16, 18 and 20 of equal size, each such cell forming a quadrant of the unitized package. Unitized package 10 has a generally rectangular configuration. With reference to container cell 20, the six cans of cell 20 are individually secured to container connecting means 22 which in this particular embodiment is a plastic sheet provided with apertures. Portions of the underlying cans are received within the apertures. When the apertured plastic sheet is in place, plastic material 26 (FIG. 2) of connecting means 22, defining each aperture, in turn underlies the respective can beads, such as bead 24. Movement of the secured cans is thereby restricted and undesired withdrawal of the cans is prevented as well.

Optionally, each container cell can also be circumscribed by a band, such as plastic straps 28, 30, 32 which serves as another container connecting means minimizing skewing of individual containers and rigidifying the respective independent container cells. Resilient film ribbon 36 is under tension and holds the individual container cells contiguous to one another and in a fixed relationship. Tension in ribbon 36 is distributed substantially uniformly across the width thereof. A fusion weld seam comprised of plural, spaced fusion weld seam segments 37 between overlapping portions of ribbon 36 extends across substantially the entire width of ribbon 36. Tab 39 is disposed adjacent to weld seam segments 37 and provides a quick-opening feature for the package.

FIG. 3 shows another embodiment of the present invention. Unitized package 40 is constituted by four container cells, such as cell 42, all of equal size. However, in this particular embodiment the individual cells are not circumscribed by a rigidifying band. Rather, the cans of each cell, such as cans 46, 48, 50, 52, 54 and 56, are secured to separate container connecting means, such as apertured plastic sheet 44. Two overlapping resilient flexible ribbons 58 and 60 circumscribe the container cells and hold these container cells contiguous to one another. Ribbons 58 and 60 both are under tension, which tension is distributed substantially uniformly across the width of each ribbon. The overlapped segment or portion of ribbons 58 and 60 also contributes to the overall rigidity of the resulting package.

A container cell 64 of three containers, such as cans 66, 68, 69, is shown in FIG. 4. This particular cell is circumscribed by band 70 which can be an endless loop or a strap segment with ends joined together by fusion, separate mechanical seal or interlock, or the like. A plurality of cells, such as cell 64, is then grouped together and a resilient film ribbon is positioned around the formed grouping to form a unitized package. Container cell 64 can be combined with like cell 72, circumscribed by band 74, and wrapped with resilient film ribbon 76 under tension to produce the unitized package having a rhomboid configuration as shown in FIG. 5. If desired, a relatively large number of such cells, e.g., six or more, can be combined and wrapped with a film ribbon under tension to produce a rigid unitized package.

The resilient film ribbon can be positioned about grouped container cells in several ways. For example, a thermoplastic film ribbon segment can be wrapped around the container cell grouping and opposite ends of the film ribbon segment joined together by fusion, either using friction fusion techniques or ultrasonic fusion techniques known in the art. Apparatus suitable for tensioning a relatively wide film ribbon about the package of this invention is shown in U.S. Pat. No. 4,479,834 to Kobiella, the disclosure of which patent is incorporated herein by reference to the extent pertinent.

In the foregoing manner the film ribbon segment can be readily provided not only with a welded seam or seams but also with a quick-opening tab adjacent to the seam or seams. Alternatively, the resilient film ribbon of desired width can be sliced from an extruded tube of the film material having the appropriate diameter, temporarily stretched, and positioned about grouped container cells with attendant partial release of the tension imparted by the temporary stretching.

It is important for the purposes of the present unitized package that sufficient tension is maintained in the resilient flexible ribbon (or ribbons) to apply a rigidifying compressive force on the individual container cells, i.e., to minimize the likelihood that the individual container cells shift or skew relative to each other during normal handling of the unitized package itself To this end, it has been found that the resilient film ribbon (or ribbons) must be under a tension of at least one pound of force per pound of total container weight. If two or more ribbons are utilized in a particular instance, the collective tension of all film ribbons circumscribing the unitized package must meet the foregoing requirement.

Also, the resulting compressive force applied to the package must be distributed over the individual container cells and the individual containers within each cell. For this purpose, the resilient film ribbon is in contact with the containers about the periphery of the package along a major portion, i.e., more than 50 percent, of the cylindrical body portion length dimension. The foregoing requirement can be met by a single ribbon as in FIG. 1, where about 80 percent of the peripheral can length dimension is in contact with the ribbon, or by plural ribbons as in FIG. 3 where the two overlapping film ribbons collectively contact substantially the entire peripheral can length dimension and distribute the resulting compressive force thereover.

In the foregoing manner a substantial compressive force can be applied to the package with attendant rigidification of same but without denting or otherwise damaging the individual containers. Of course, the tensioning of the film ribbon or ribbons must not be so great as to destroy the configurational integrity of the individual containers. As a practical matter, for twelve-ounce aluminum beverage cans the tension of the flexible film ribbon is in the range of about one to about two pounds force per pound of weight of the package.

It has been found that oriented polypropylene film having a thickness of about 3 to about 5 mils is a particularly well suited material for the resilient film material. Also, the thermoplastic property of this particular film material permits the ready bonding of the tensioned film ribbon in a relatively short time period as is required in the current relatively high speed bottling and canning operations. However, other film materials having the necessary tensile strength and stress decay properties can be employed as well.

While friction fusion of tensioned ribbon ends is a particularly suitable expedient for the present packaging purposes, especially where a quick-opening tab for the package is desired, bonding with a rapidly-setting glue or like expedients can also be used where production rates and volumes permit.

Film materials for the present resilient film ribbons must have a tensile strength at break of at least about 35,000 pounds per square inch (psi), preferably about 40,000 psi to about 50,000 psi, a maximum elongation at break of about 25 percent, creep modulus at ambient temperature, defined as applied stress in pounds per square inch/creep strain in inches per inch, of at least $60\times10^3$ at 10,000 minutes at an applied stress of 10,000 pounds per square inch, and a secant modulus (modulus of elasticity) at 30 pounds force of at least 260,000 psi. Preferably, elongation at break is about 18 percent to about 22 percent. Materials meeting the foregoing criteria also possess the desired stress decay properties.

The foregoing description exemplifies preferred embodiments of the present invention. Still other variations and rearrangements of component parts are possible without departing from the spirit and scope of this invention and will readily present themselves to one skilled in the art.

I claim:

1. A unitized package constituted by a plurality of substantially uniform containers arranged in rows and columns, each container having a cylindrical body portion, and comprising:

at least two contiguous but separate, integral container cells of equal size; and a resilient but relatively inelastic film ribbon of oriented polypropylene under tension, circumscribing said contiguous container cells;

each said container cell including a separate container connecting means, and at least two containers aligned with one another and individually gripped by the connecting means so that movement of the gripped containers relative to one another is restricted; and said resilient film ribbon being in contact with containers about the periphery of the package along a approximately 50% of the length of the cylindrical body portion length dimension and being under a tension of at least about one pound force per pound of total package weight but less than a tension that impairs the configurational integrity of individual containers in the package, said tension being distributed substantially uniformly across the width of the film ribbon, said film ribbon including a fusion welded seam substantially across the width of the ribbon at overlapping extremities of the ribbon.

2. The unitized package in accordance with claim 1 wherein the containers are cylindrical cans.

3. The unitized package in accordance with claim 1 wherein said container connecting means is a band circumscribing the containers in the cell.

4. The unitized package in accordance with claim 1 wherein said container connecting means is an apertured plastic sheet.

5. The unitized package in accordance with claim 1 wherein a pair of resilient film ribbons circumscribe the contiguous container cells and together are in contact with substantially the entire cylindrical body portion length dimension of containers about the periphery of the package.

6. The unitized package in accordance with claim 1 wherein four container cells are present in each package, six containers are present in each cell, and the cells are situated in the package with respect to one another so that each cell forms a quadrant of the package.

7. The unitized package in accordance with claim 1 wherein the fusion weld seam is between overlapping ribbon portions.

8. The unitized package in accordance with claim 1 wherein the fusion weld seam is between overlapping ribbon portions and a tab means unitary with the film ribbon is situated adjacent to the weld seam.

9. A unitized package constituted by a plurality of substantially uniform containers arranged in rows and columns, each container having a cylindrical body portion, and comprising:

at least two contiguous but separate, integral container cells of equal size; and a resilient but relatively inelastic film ribbon of oriented polypropyene under tension, circumscribing said contiguous container cells;

each said container cell including a separate container connecting means, and at least two containers aligned with one another and individually gripped by the connecting means so that movement of the gripped containers relative to one another is restricted; and said resilient film ribbon being in contact with containers about the periphery of the package along a major portion of the cylindrical body portion length dimension and being under a tension of at least about one pound force per pound of total package weight but less than a tension that impairs the configurational integrity of individual containers in the package, said tension being distributed substantially uniformly across the width of the film ribbon, each container cell further being connected by a continuous resilient elastic band circumscribing the outer periphery of each cell, said film ribbon under tension being juxtaposed over a portion of the width of the bands that are exposed to the outer periphery of the unitized package.

10. The unitized package of claim 9 wherein the contiguous but separate container cells include 12 containers each subgrouped into arrays of 6 containers which are individually gripped by the separate container connecting means.

* * * * *